United States Patent [19]

Learnard

[11] Patent Number: 4,519,510

[45] Date of Patent: May 28, 1985

[54] ROTATABLE DISPLAY STAND

[76] Inventor: Stanley J. Learnard, 12659 Willow Spring Ct., Herndon, Va. 22070

[21] Appl. No.: 624,778

[22] Filed: Jun. 26, 1984

[51] Int. Cl.[3] ..... A47F 5/02

[52] U.S. Cl. ..... 211/131; 40/607; 211/58; 211/163

[58] Field of Search ..... 211/131, 163, 129, 133, 211/181, 56, 50, 58; 40/124.2, 484, 493, 494, 503, 506, 606, 607

[56] References Cited

U.S. PATENT DOCUMENTS

| | | | |
|---|---|---|---|
| 1,425,846 | 8/1922 | Franks | 211/163 |
| 3,223,247 | 12/1945 | Bleed | 211/58 X |
| 3,292,797 | 12/1966 | Berk | 211/163 |
| 4,296,866 | 10/1981 | Learnard | 211/131 |
| 4,300,299 | 11/1981 | Batky et al. | 40/607 |

FOREIGN PATENT DOCUMENTS

| | | | |
|---|---|---|---|
| 2443821 | 8/1980 | France | 211/58 |

*Primary Examiner*—Robert W. Gibson, Jr.
*Attorney, Agent, or Firm*—Dennis H. Lambert

[57] ABSTRACT

A lightweight yet sturdy article display stand is rotatable on a pedestal base, and comprises a substantially box- or cube-shaped arrangement of panels having a suitably finished outer surface and forming a back for a plurality of article-supporting pockets defined by wire members. The panels are fixed on the outer peripheral edges of one or more generally horizontal frame plates rotatably supported on the base, and comprise a part of the frame for the structure. The pocket-forming wire members encircle the panels at the location of the frame plate, defining a wrap or reinforcement for the structure. Variations of the invention include poster display and storage pockets, and bulletin board or message-card holders.

14 Claims, 25 Drawing Figures

FIG 1
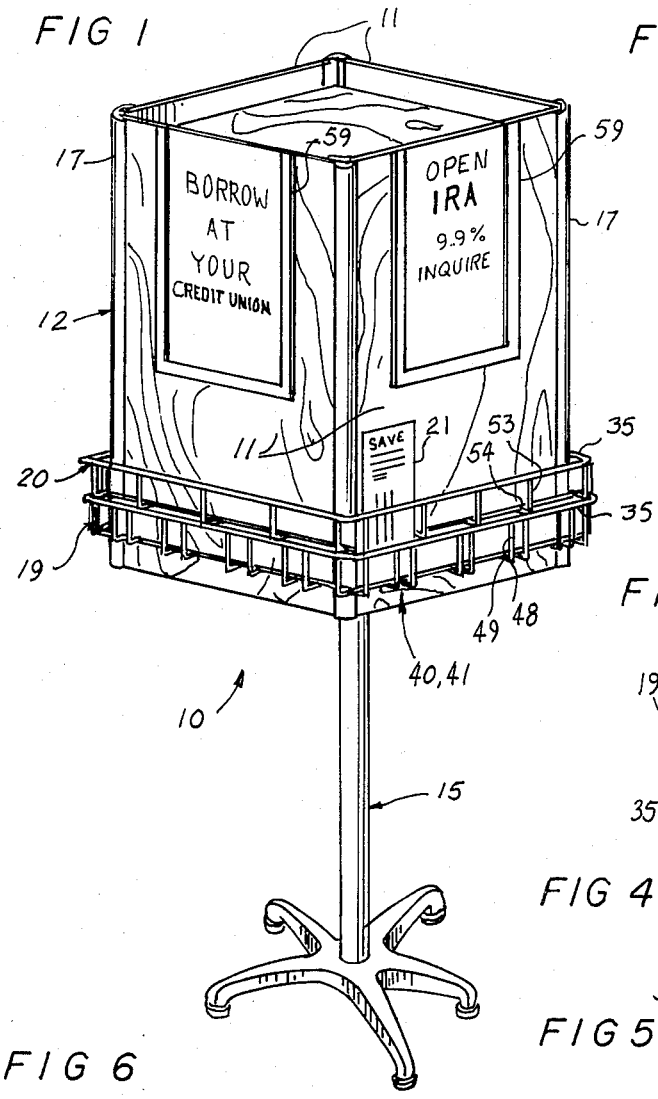
FIG 2
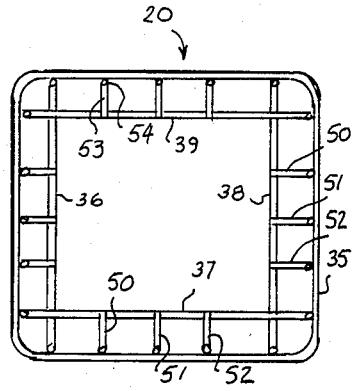
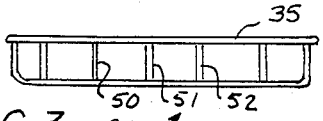
FIG 3
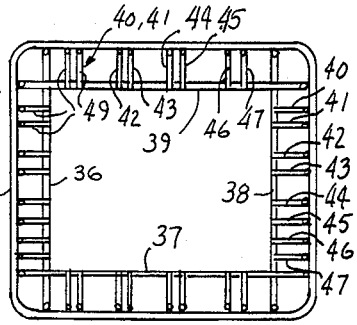
FIG 4
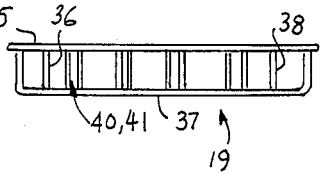
FIG 5
FIG 6
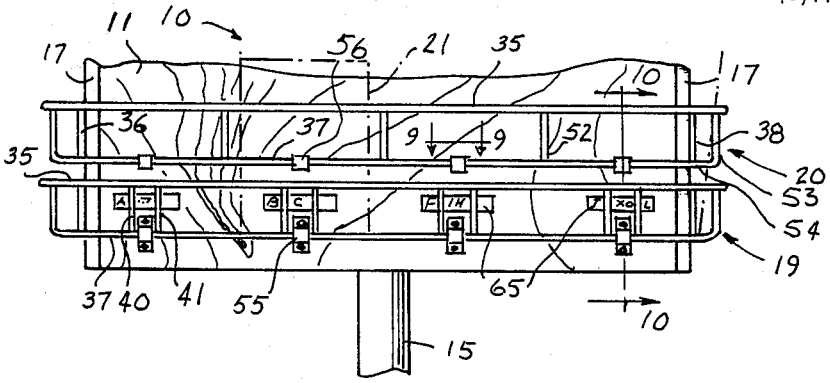

ROTATABLE DISPLAY STAND

BACKGROUND OF THE INVENTION

1. Field of the Invention

This invention relates to display stands or racks, and more particularly, to display stands for displaying articles such as advertising brochures, pamphlets, road maps, books, and the like. The invention is an improvement over applicant's prior U.S. Pat. No. 4,296,866.

2. Prior Art

Many different types of stands for displaying such articles are known in the prior art, including both stationary racks or stands and rotatable racks or stands. Such racks or stands generally have means defining a plurality of pockets sized approximately to the articles to be supported therein. An example of a typical prior art rotatable article display stand is commonly located in drug stores, department stores and the like for supporting and displaying greeting cards.

Banks and similar businesses generally display various advertising brochures and literature explaining the banking services, but such materials are generally displayed in fixed display devices since most of the prior art devices are either unsuitable for use in banks and the like, because of their appearance or cost, or lack of adaptability to the limited number of brochures and the like generally displayed by banks. Moreover, it is sometimes desireable to provide a bulletin board or similar display surface in a bank lobby or the like, and most of the prior art display racks or stands do not lend themselves to use as bulletin boards or the like. Examples of some prior art devices are disclosed in U.S. Pat. Nos. 2,065,845, 3,452,880, 3,150,778 and 4,093,077.

Applicant's prior U.S. Pat. No. 4,296,866 solved many of the problems found in the prior art, and defines a device which is constructed such that it may readily be used as a bulletin board support or the like. Moreover, the appearance of the display rack described in this patent is particularly suitable for use in bank lobbies or other similar locations. However, this device is relatively heavy and expensive in construction.

SUMMARY OF THE INVENTION

Therefore, it is a principle object of this invention to provide an article display rack which is simple and economical in construction, and yet which is sturdy and attractive.

Another object of the invention is to provide an article display rack or stand which includes means for supporting articles such as advertising brochures, pamphlets, and the like, and also includes poster display and storage means.

A further object of the invention is to provide an article display stand in which the various elements of the structure form a part of the frame of the device or serve to reinforce the structure, as well as to form display surfaces or pockets for displaying articles.

Yet another object of the invention is to provide an article display stand in which a box-like arrangement of panels is rotatably supported on top of a pedestal base, the panels having a suitable finish thereon and forming a back for a plurality of article supporting pockets defined by wire members encircling the panels and reinforcing the structure.

These and other objects and advantages of the invention are achieved by the structure described in detail hereinafter, and in which a plurality of essentially rectangular panels are held assembled in a box-like configuration, forming a back for a plurality of article-supporting pockets defined in part by wire members which encircle the panels. At least one generally horizontal frame plate is rotatably supported on top of a pedestal base, and the panels are fixed to the outer peripheral edge of the plate. The encircling wire members are located at the position of the plate and serve to reinforce the structure, in addition to their function defining article supporting pockets. Further, longitudinal or vertically extending corner pieces are fixed along the adjacent vertical edges of the panels, enhancing the appearance of the structure as well as serving to hold it in assembled relationship.

Variations of the invention include poster display and storage means on the panels, and message card or bulletin board display means.

BRIEF DESCRIPTION OF THE DRAWINGS

Further advantages of the invention will become apparent from the following detailed description and accompanying drawings, in which like reference characters refer to like parts throughout the several views, and in which:

FIG. 1 is a top perspective view of a preferred form of the invention, showing article support pockets in combination with poster display and storage means;

FIG. 2 is a top plan view of the top wire member of the article-supporting pocket forming means of FIG. 1;

FIG. 3 is an edge view in elevation of the wire member of FIG. 2;

FIG. 4 is a top plan view of the bottom wire member of the pocket forming means of FIG. 1;

FIG. 5 is an edge view of the wire member of FIG. 4;

FIG. 6 is an enlarged fragmentary view in elevation of a portion of the display stand of FIG. 1, showing further details of the wire members forming the article support pockets;

DESCRIPTION OF THE PREFERRED EMBODIMENTS

Figure 7:
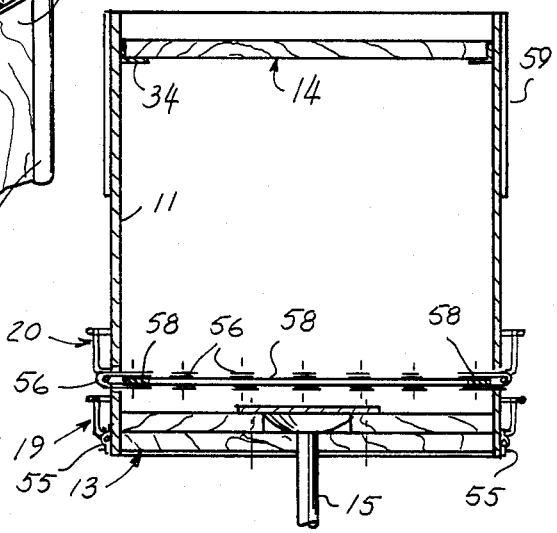
FIG. 7 is a fragmentary, perspective view of a portion of the display stand of FIG. 1.
Figure 8:
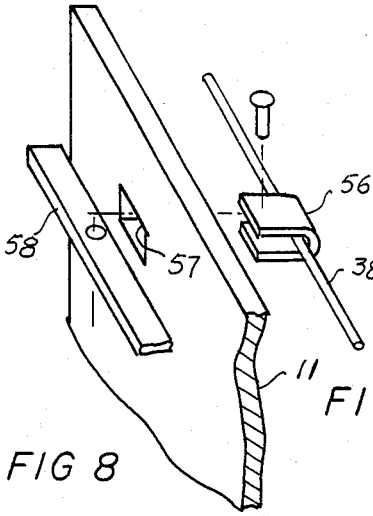
FIG. 8 is an exploded, perspective view of a portion of the structure of FIG. 1, showing the method of attachment of the top wire member to the device.
Figure 9:
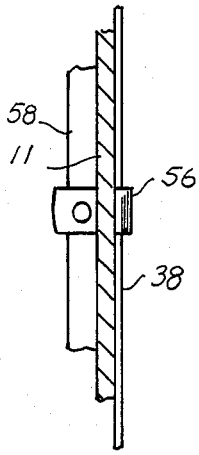
FIG. 9 is a fragmentary, sectional view taken along line 9—9 in FIG. 6.
Figure 10:
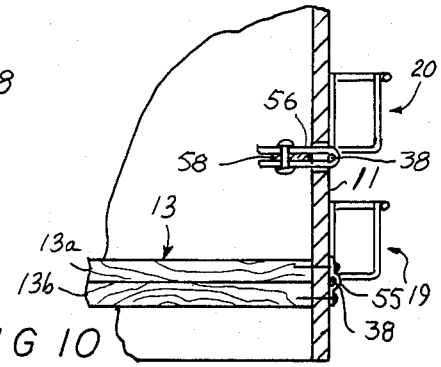
FIG. 10 is a fragmentary sectional view taken along line 10—10 in FIG. 6.
Figure 11:
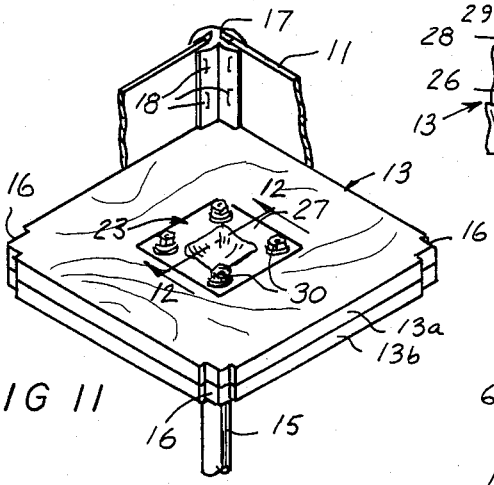
FIG. 11 is a fragmentary sectional view, with portions broken away, of the frame plate and pedestal base of the display stand of FIG. 1.
Figure 12:
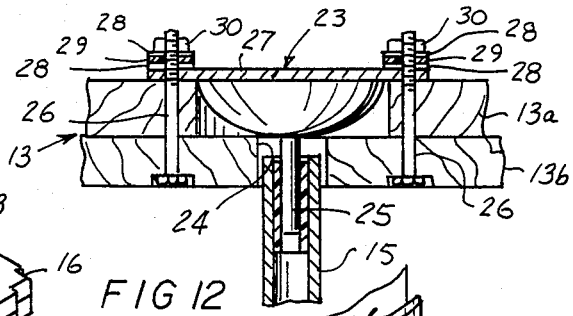
FIG. 12 is an enlarged, fragmentary view in section of the attachment of the frame plate to the pedestal, and is taken along line 12—12 in FIG. 11.
Figure 13:
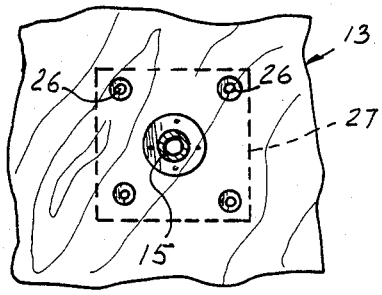
FIG. 13 is a fragmentary plan view of the underside of the frame plate of FIG. 11.
Figure 14:
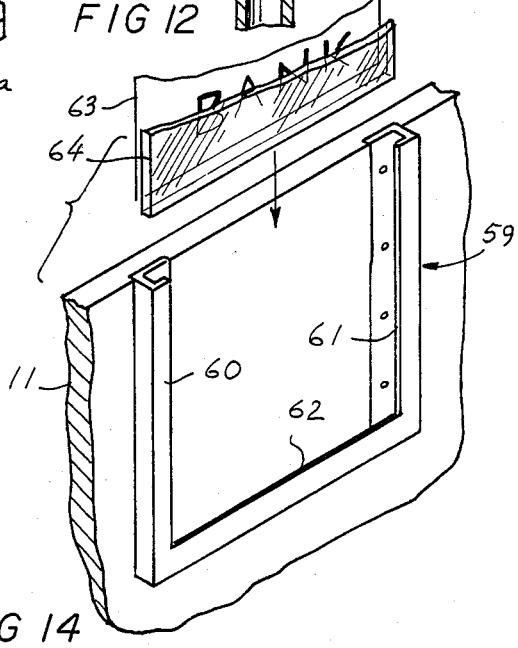
FIG. 14 is an enlarged, fragmentary perspective exploded view of the poster display and storage means of FIG. 1.
Figure 18:
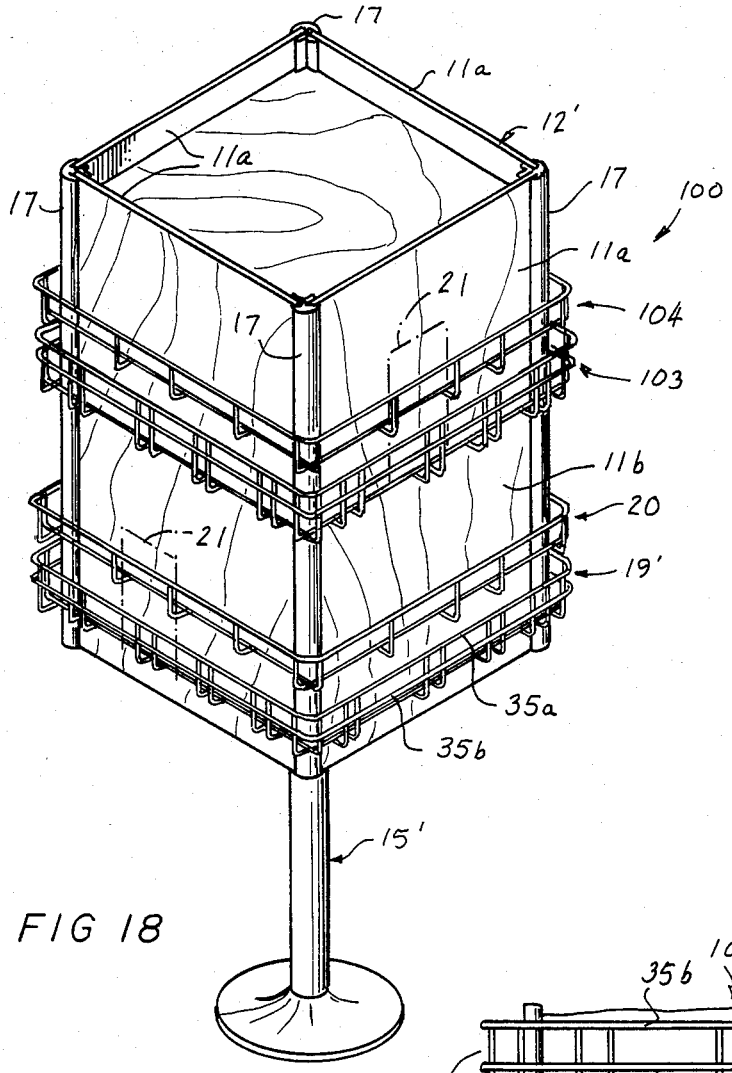
FIG. 18 is a top perspective view similar to FIG. 1 of a first modification of the invention.
Figure 19:
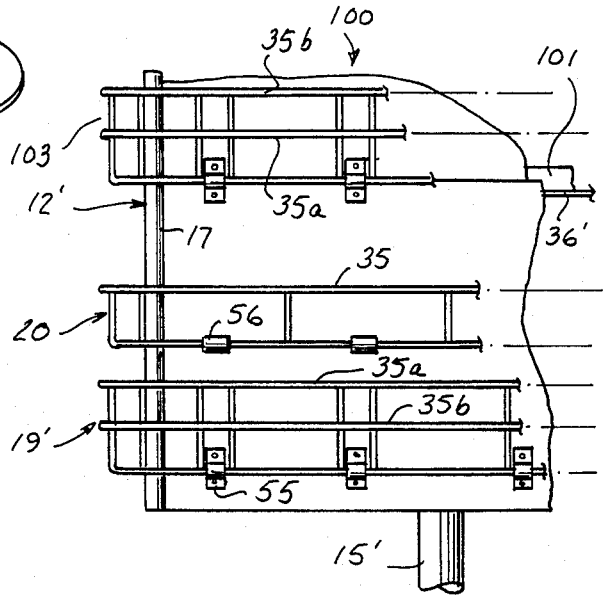
FIG. 19 is an enlarged, fragmentary view in elevation of a bottom corner portion of the device of FIG. 18.
Figure 20:
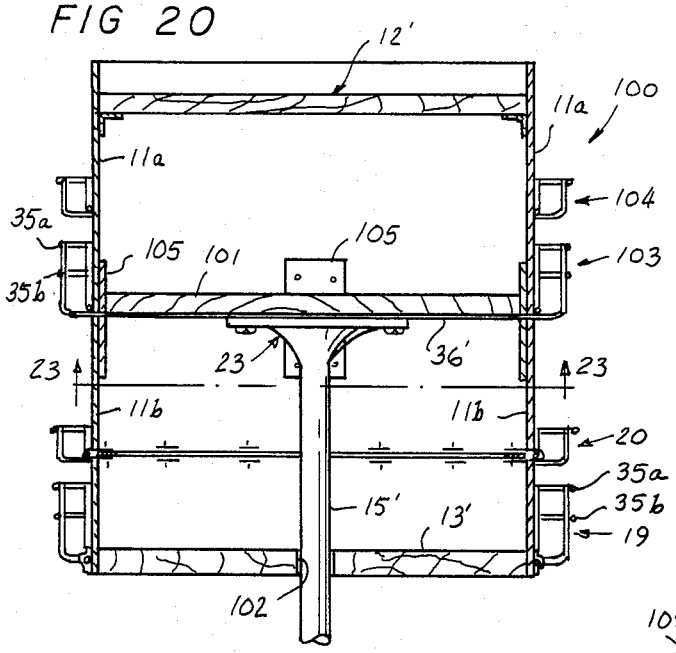
FIG. 20 is a vertical sectional view of the device of FIG. 18.
Figure 21:
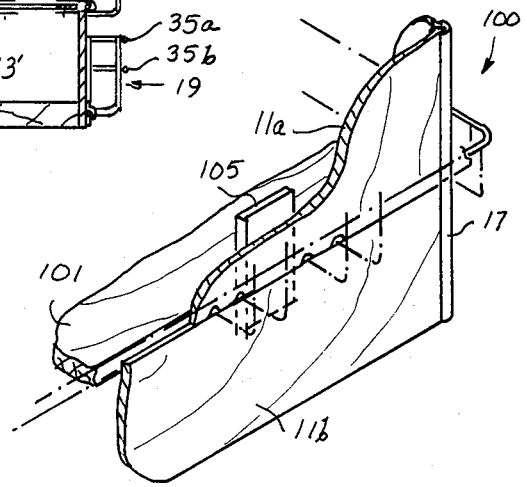
FIG. 21 is an enlarged, fragmentary perspective view, with portions borken away, of the structure of FIG. 20.
Figure 22:
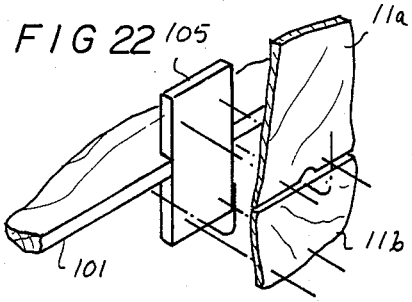
FIG. 22 is a greatly enlarged, fragmentary perspective view of a part of the structure for attaching the panels to the frame plate in the device of FIG. 18.
Figure 23:
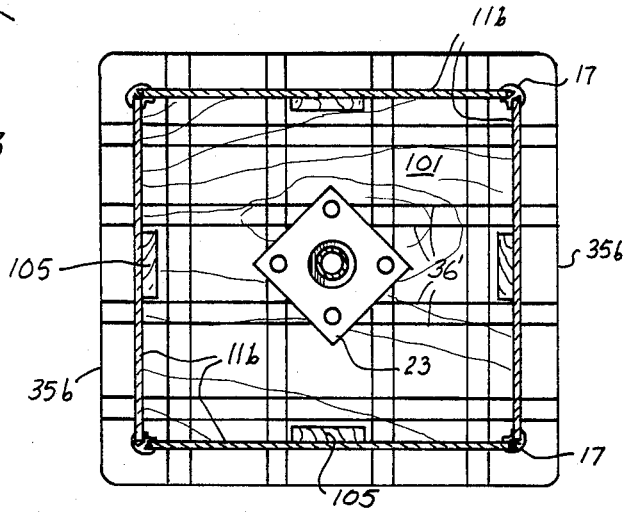
FIG. 23 is a bottom plan view of the top frame plate in the device of FIG. 20, and is taken along line 23—23 in FIG. 20.

Referring more particularly to the drawings, a first form of article display stand is indicated generally at 10 in FIGS. 1 through 17. The stand 10 comprises a plurality of panels 11 assembled in a box-like configuration 12. The panels have a suitably finished surface, such as wood-grain or the like, and, as seen best in FIGS. 7, 10 and 11, are fixed to the outer peripheral edge of a bottom frame plate 13 and a top frame plate 14. The bottom frame plate 13 is rotatably supported on top of a pedestal base 15, and has its corner notched at 16 to provide clearance for corner members 17 extending vertically between adjacent edges of the panels 11 and fixed thereto as by staples 18 or the like. Thus, the panels are secured to one another via the corner members and the frame plates, providing a very sturdy box-like structure. First and second shaped annular wire members 19 and 20 extend around the bottom of the box-like structure 12 in the vicinity of the bottom frame plate 13, forming article-supporting pockets for holding and displaying a plurality of advertising brochures, pamphlets, etc. 21. In addition to forming article supporting pockets, the wire members 19 and 20 wrap around the structure, reinforcing it and helping to prevent stress and splitting of the bottom frame plate.

As seen in FIGS. 7, 10, 11 and 12, the bottom frame plate 13 comprises a pair of plates **13*a* and 13*b* laminated together, with the top plate 13*a* having the central portion thereof cut out at 22 to accommodate a flanged support 23. The bottom plate 13*b* also has a cut out 24 in the central portion thereof, and a depending pin 25 on the support 23 extends therethrough. A plurality of bolts 26 extend through both plates 13*a* and 13*b* and through the flange 27 of the support 23. A pair of metal washers 28 with a rubber gasket 29 sandwiched therebetween are received on each bolt between the flange 27 and nuts 30** to reduce noise and stress.

Figure 15:
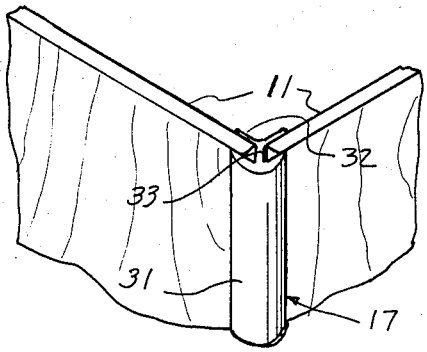
FIG. 15 is a fragmentary top perspective view of one corner of the device of FIG. 1, showing the corner piece.
Figure 16:
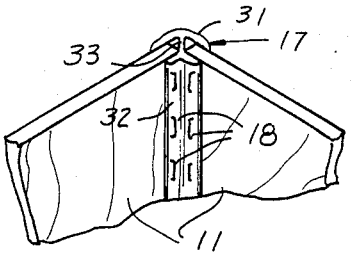
FIG. 16 is a view similar to FIG. 15, showing the inside of the corner and the manner of attachment of the corner piece to the panels.

The corner members 17, as seen best in FIGS. 1, 15 and 16, extend the length of the panels 11 and have a shaped or rounded outer portion 31 covering the exposed edges of the panels and providing an attractive appearance. The corner members also have an angle-shaped inner portion 32 lying against the inner adjacent edge surfaces of the panels and defining means for stapling the corner member to the panels (see FIG. 16). The inner and outer portions of the corner members define channels in which the edges of the panels are received, and are joined by a web 33.

Figure 17:
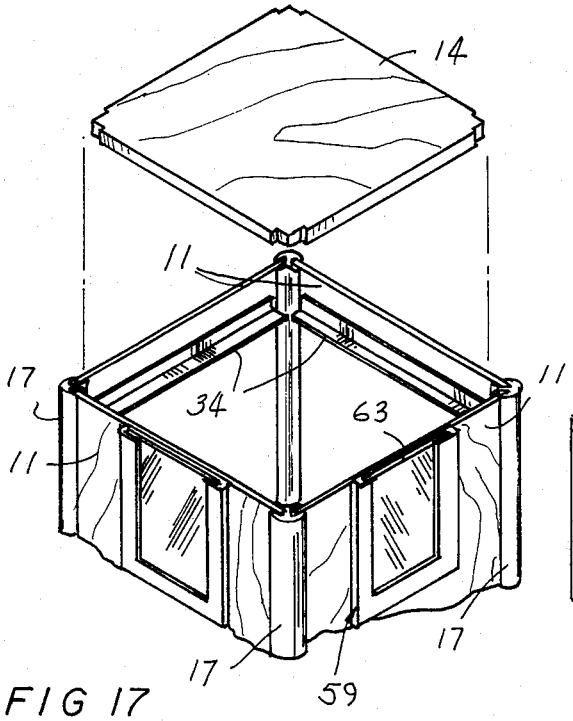
FIG. 17 is an exploded, fragmentary perspective view of the top portion of the device of FIG. 1, showing the manner of attachment of the top plate.

The top frame plate 14 rests on top of a plurality of angle members 34 secured around the inside surface of the panels adjacent the top thereof (see FIGS. 7 and 17).

Details of construction of the first and second wire members 19 and 20 are seen best in FIGS. 1 through 10. The wire members are annularly shaped (FIGS. 2 and 4), each having an upper peripheral rim or wire 35 spaced from the panels 11, and depending wires 36, 37, 38 and 39 extending from one side to the opposite side of the member in close proximity with the outer surfaces of the panels 11. Thus, the wire members serve as a "wrap" around the structure 12, reinforcing it. The first wire member 19, in addition to the structure described above, also has four pairs of equidistantly spaced L-shaped wires 40–41, 42–43, 44–45 and 46–47 spaced along each side and extending from their upper ends at the upper peripheral rim 35 downwardly along vertical leg 48 and then inwardly along horizontal leg or foot 49 to the inner marginal depending wires 36–39, respectively. These pairs of wires serve as bottoms to the pockets defined by the wire members. The second wire member, in addition to the structure described above and common to both wire members, has a plurality of equidistantly spaced L-shaped wires 50, 51 and 52 spaced along the sides of the wire member 20, and extending downwardly along a first leg 53 from an upper end secured to the rim 35 and inwardly along a second leg or foot 54 to the inner marginal depending wires 36–39, respectively. These wires serve as side supports for articles placed in the pockets.

The wire members 19 and 20 are secured to the panels and frame plate by brackets 55 and clips 56, respectively, as shown best in FIGS. 6–10. As noted previously, the depending inner marginal wires 36–39 of the first wire member 19 extend is substantial alignment with the plane of bottom frame plate 13, and the brackets 55 are secured over these wires and to the panels 11 and the edges of plate 13. Any suitable fasteners may be used, such as rivets, screws, etc. The depending inner marginal wires 36–39 of the second wire member 20 are secured to the panels 11 by means of the clips 56, which comprise short straps or strips of suitable material, such as plastic or the like, wrapped around the wires and inserted through aligned slots 57 in the panels 11. The ends of these straps or clips are then riveted or otherwise suitably secured to a thin, flat bar 58 at the inner surface of the panels 11.

Poster display and storage means 59 are formed on each of the panels near the top and spaced upwardly from the wire members 19 and 20 and comprise a pair of vertically extending spaced apart channel members 60 and 61, opening toward one another, and a bottom channel member 62, opening upwardly. The channel members are recessed into the surface of the panel 11, so that a continuous flush surface is formed completely across the display means by the surface of the panel and the back leg of the channel members. One or more posters 63 may be placed behind a transparent panel (glass, plastic, etc.) 64 received in the channel members.

As seen in FIG. 6, labels 65 may be placed in association with each pocket to identify the brochure, etc., to be placed therein. When brochures, etc., are present in the pocket, these labels are not visible to customers.

A second form of the invention is indicated generally at 100 in FIGS. 18 through 23 and, as before, comprises a plurality of panels secured to the outer peripheral edges of top and bottom frame plates and having first and second wire members forming article support pockets near the bottom of the box-like structure defined by the panels. However, in this form of the invention the panels are divided into top and bottom halves 11*a* and 11*b*, and the structure is supported from a middle frame plate 101 rotatably supported at the top of a pedestal base 15' extending upwardly through a hole 102 in the center of the bottom frame plate 13', which remains free of attachment with the pedestal. Further, instead of the poster display and storage means 59, third and fourth wire members 103 and 104 are attached to the structure in the vicinity of the middle frame plate 101. While the fourth wire member 104 is identical in construction to the second wire member 20 (which is, in turn, identical to that earlier described), the third wire member 103 is basket-shaped and extends completely across the interior of the box-like structure 12'. In other words, instead of the L-shaped wires 36–39 of FIGS. 1–17, the "feet" 36'–39' extend from one side to the other of the structure. A flanged support 23 at the upper end of the pedestal base is bolted to the underside of the middle frame plate 101, with the wires of the wire member 103 sandwiched therebetween. Further, the bottom edges of the upper panels 11*a* are notched to provide clearance for the wires 36'–39'. Connecting plates 105 are fitted in notches 106 formed in the edges of the plate 103 and are secured to the top and bottom panels 11*a* and 11*b* to unify the structure.

In addition to the changes noted above, both the first wire member 19' and the third wire member 103 have a pair of vertically spaced rim wires 35*a* and 35*b* rather than the single rim wire 35 as described in connection with the first form of the invention.

Figure 24:
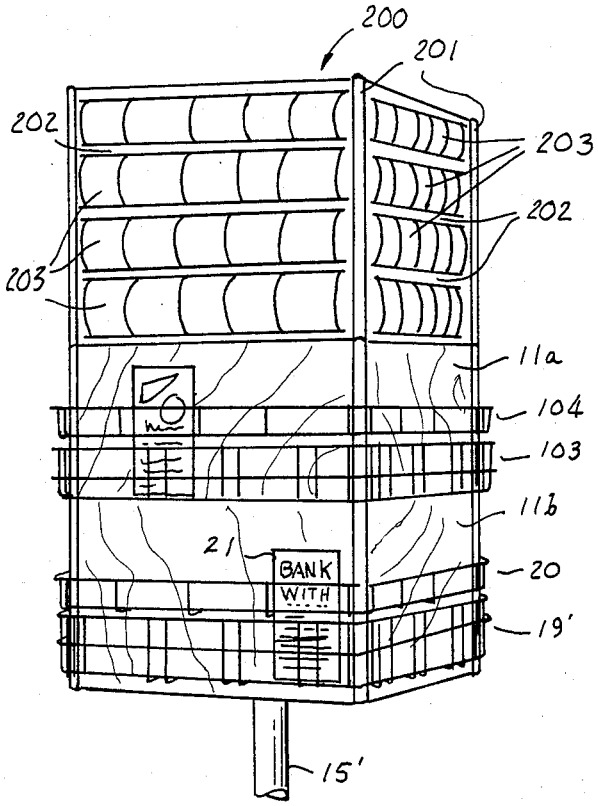
FIG. 24 is a perspective view of a second modification of the invention, wherein a card-message or bulletin board means is in combination with the article support pockets.
Figure 25:
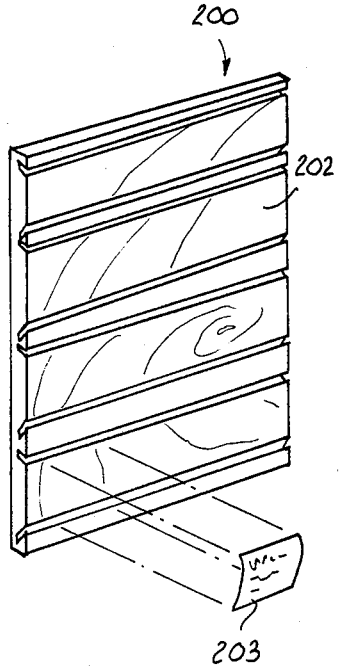
FIG. 25 is a perspective view of the card holding panel of FIG. 24.

A third form of the invention is shown in FIGS. 24 and 25 at 200, and is constructed substantially similarly to the construction of the second form of the invention, 100, except that extended corner members 201 project upwardly beyond the upper edge of panels 11*a*, and a plurality of notched panels 202 are supported thereby for holding message cards 203 or the like. The notched panels 202 may be further supported and rigidified by an arrangement similar to that shown in FIG. 21, wherein connecting plates would be provided between the panels 11*a* and 202. Also, aluminum angles may be extended in the inside corners of the box-like structure.

It should be noted that the recessed area at the top of the structure may be used for storage of extra brochures, etc., if desired.

The panels 11, 11*a*, 11*b* and 202 may comprise masonite or the like, and the frame plates may comprise wood. Other suitable materials may obviously be used if desired.

While the invention has been shown and described in detail, it is to be understood that various changes in construction may be made without departing from the spirit and scope of the invention as defined by the appended claims.

Having thus described the invention, what is claimed is:

1. A rotatable article display stand, comprising:

a pedestal base;

a generally horizontal frame plate rotatably supported on top of said pedestal base;

a plurality of substantially vertical, generally rectangular panels fixed to the peripheral edge of said frame plate and defining a generally box-like structure;

wire members secured to said panels around the outside thereof in the vicinity of said frame plate, defining a plurality of pockets for holding and displaying advertising brochures, pamphlets and the like, said wire members also reinforcing said structure; and corner members extending vertically along the corners of said box-like structure, fixed to the adjacent edges of the panels and securing them together.

2. A display stand as in claim 1, wherein:

the wire members are generally annularly shaped, and include a first wire member and a second wire member, said first wire member having wires defining bottoms for said pockets, and said second wire member having wires defining sides for said pockets.

3. A display stand as in claim 2, wherein:

said wire members include a top wire or rim circumscribing said box-like structure in spaced relation thereto, and a plurality of bottom wires extending along the sides of said box-like structure contiguous thereto.

4. A display stand as in claim 2, wherein:

fastening means engage said bottom wires and said panels, holding said wire members to said panels.

5. A display stand as in claim 1, wherein:

poster display and storage means is on an upper outer surface portion of said panels.

6. A display stand as in claim 5, wherein:

said frame plate is disposed near the bottom edges of said panels; and a second frame plate is secured to said panels near the top edges thereof.

7. A display stand as in claim 6, wherein:

said corner members have longitudinal channels along the opposite edges thereof, and the edges of adjacent panels are received in said channels.

8. A display stand as in claim 4, wherein:

at least some of said fastening means comprise straps wrapped around said bottom wires, with the ends thereof extended through slots in the panels, and said ends being fixed to a bar disposed behind said panel.

9. A display stand as in claim 1, wherein:

said wire members include first and second wire members near the bottom of said panels, and third and fourth wire members approximately midway between the top and bottom ends of said panels.

10. A display stand as in claim 9, wherein:

said frame plate is disposed approximately midway between the top and bottom ends of said panels; and a second frame plate is secured to said panels at the bottom ends thereof, said second frame plate having a central opening therein through which the pedestal extends.

11. A display stand as in claim 10, wherein said first, second and fourth wire members are generally annularly shaped, said first and third wire members having wires defining bottoms for said pockets, and said second and fourth wire members having wires defining sides for said pockets, all of said wire members including a top wire or rim circumscribing said box-like structure in spaced relation thereto, and a plurality of bottom wires extending along the sides of the box-like structure contiguous thereto.

12. A display stand as in claim 11, wherein:

said panels include separate top and bottom halves, with the juncture between the halves disposed at the level of said frame plate; and said third wire member has a plurality of bottom wires extending between the panel top and bottom halves and across said box-like structure beneath said frame plate, said bottom wires being engaged and supported between said frame plate and said pedestal.

13. A display stand as in claim 12, wherein:

said frame plate has a plurality of notches in the peripheral edge thereof; and connecting plates are disposed in said notches and secured to the top and bottom panel halves.

14. A display stand as in claim 10, wherein:

a plurality of horizontally grooved panels are disposed above said third and fourth wire members, said grooves being adapted to receive and hold the opposite edges of a plurality of message cards therein.

* * * * *